US008005235B2

(12) United States Patent
Rebandt, II et al.

(10) Patent No.: US 8,005,235 B2
(45) **Date of Patent: *Aug. 23, 2011**

(54) MULTI-CHAMBER NOISE CONTROL SYSTEM

(75) Inventors: Robert G. Rebandt, II, Wayne, MI (US); Ming-te Cheng, Ann Arbor, MI (US); Takeshi Abe, Garden City, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1285 days.

This patent is subject to a terminal disclaimer.

(21) Appl. No.: 11/638,826

(22) Filed: Dec. 14, 2006

(65) Prior Publication Data

US 2008/0144852 A1 Jun. 19, 2008

(51) Int. Cl.
*G10K 11/16* (2006.01)

(52) U.S. Cl. ..... 381/71.4; 381/71.1; 381/71.5; 381/71.7; 381/86; 181/295; 181/296; 181/206; 181/224

(58) Field of Classification Search ..... 381/71.1, 381/71.3–71.5, 86; 181/206, 293, 199, 148, 181/295–296, 224

See application file for complete search history.

(56) References Cited

U.S. PATENT DOCUMENTS

| | | | | |
|---|---|---|---|---|
| 4,506,380 | A | 3/1985 | Matsui | 381/71 |
| 4,574,915 | A | 3/1986 | Gahlaii | 181/290 |
| 5,094,318 | A | 3/1992 | Maeda | 181/290 |
| 5,131,047 | A | 7/1992 | Hashimoto | 381/71 |
| 5,321,759 | A | 6/1994 | Yuan | 381/71 |
| 5,386,372 | A * | 1/1995 | Kobayashi et al. | 700/280 |
| 5,554,831 | A | 9/1996 | Matsukawa | 181/294 |
| 5,817,408 | A | 10/1998 | Orimo | 428/218 |
| 6,041,125 | A * | 3/2000 | Nishimura et al. | 381/71.4 |
| 6,102,465 | A | 8/2000 | Nemoto | 296/36.3 |
| 6,305,294 | B1 | 10/2001 | Hashino | 104/91 |
| 6,343,127 | B1 * | 1/2002 | Billoud | 381/71.4 |
| 6,554,101 | B2 | 4/2003 | Watanabe | 181/290 |
| 6,589,643 | B2 * | 7/2003 | Okada | 428/297.4 |
| 6,767,050 | B2 * | 7/2004 | Junker | 296/193.02 |
| 6,912,454 | B2 * | 6/2005 | Astorino | 701/36 |
| 7,017,250 | B2 * | 3/2006 | Gebreselassie | 29/428 |
| 7,070,848 | B2 * | 7/2006 | Campbell | 428/137 |
| 7,536,018 | B2 * | 5/2009 | Onishi et al. | 381/71.8 |
| 2003/0215101 | A1 * | 11/2003 | Stuart et al. | 381/71.4 |
| 2004/0130081 | A1 * | 7/2004 | Hein | 267/140.14 |
| 2004/0240678 | A1 * | 12/2004 | Nakamura | 381/71.11 |
| 2005/0150720 | A1 * | 7/2005 | Tudor | 181/286 |
| 2005/0226434 | A1 * | 10/2005 | Franz et al. | 381/71.7 |
| 2005/0276422 | A1 * | 12/2005 | Buswell et al. | 381/71.14 |

* cited by examiner

*Primary Examiner* — Devona Faulk
*Assistant Examiner* — Disler Paul
(74) *Attorney, Agent, or Firm* — Gregory P. Brown; MacMillan, Sobanski & Todd, LLC

(57) ABSTRACT

A noise control system is operable within a box-like structure provided by the dual bulkhead plenum of the vehicle dashboard positioned within the transfer path along which the noise is being transmitted from the source of the generated noise to the receiver of the noise in the passenger compartment of an automobile. The plenum is divided into discrete chambers into each of which is provided a counter noise generating apparatus to create a counteracting noise offsetting the noise generated at the source. The acoustic resonance of the chambers amplifies the noise control energy. The geometry of the individual chambers can be varied to optimize the packaging and sound control or shaping strategy. The sound energy permitted to pass through the plenum to the driver's side of the passenger compartment can be tuned to be different than the noise received in the passenger's side.

20 Claims, 4 Drawing Sheets

Fig. 1
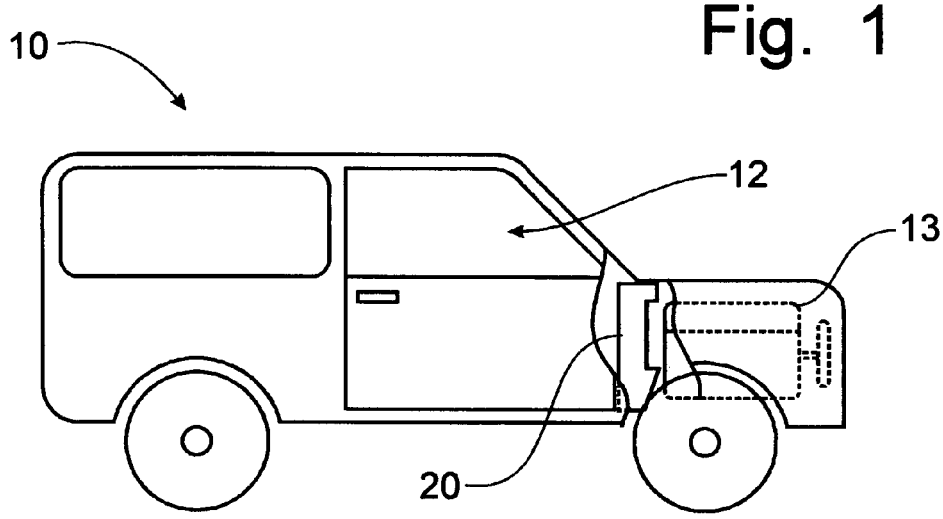
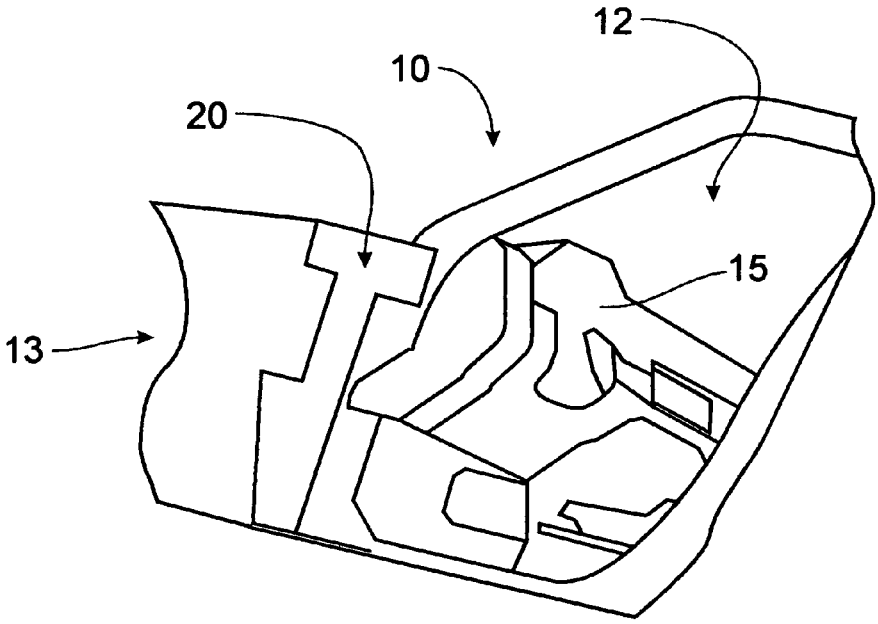
Fig. 2

Fig. 3
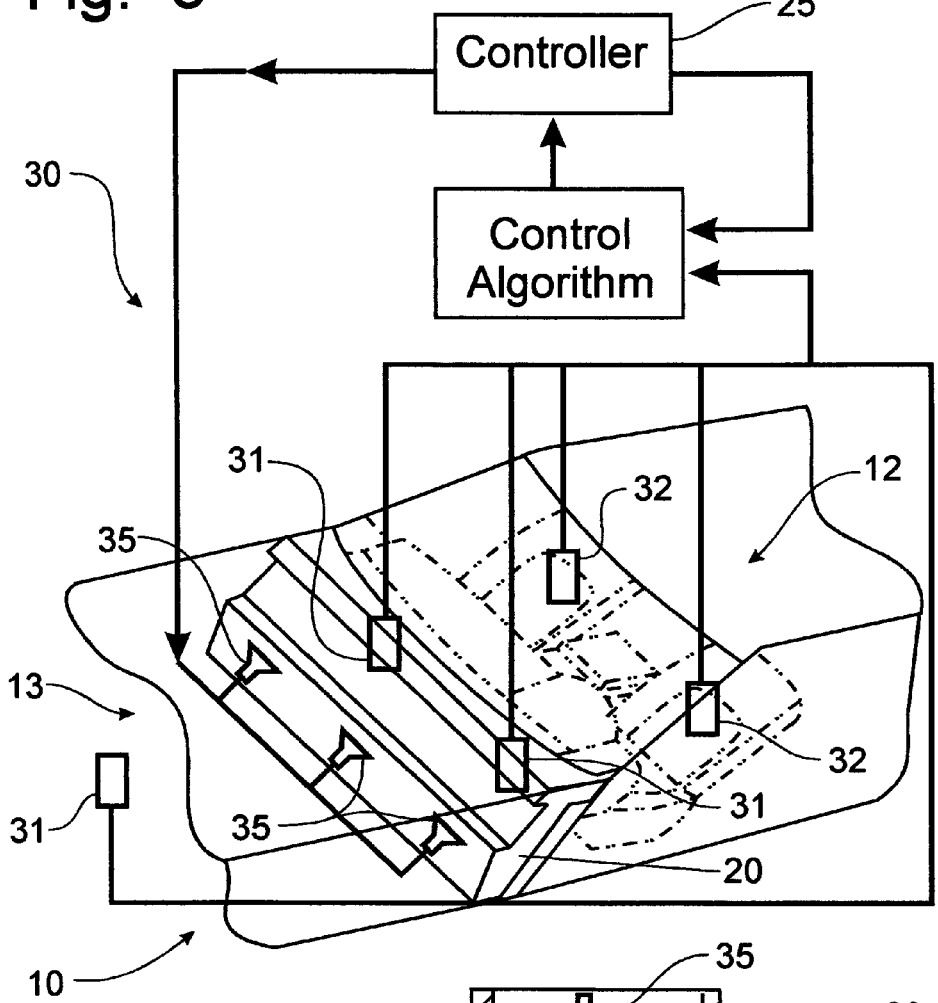
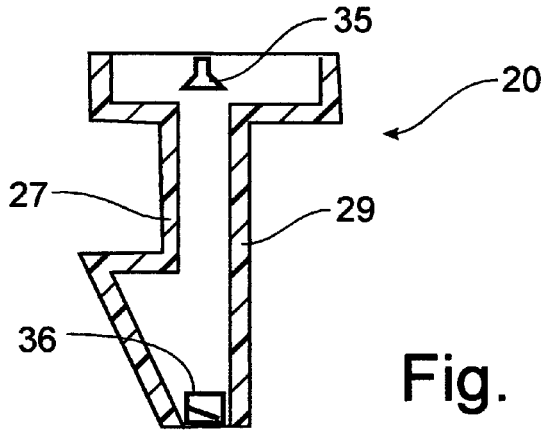
Fig. 4

Fig. 5
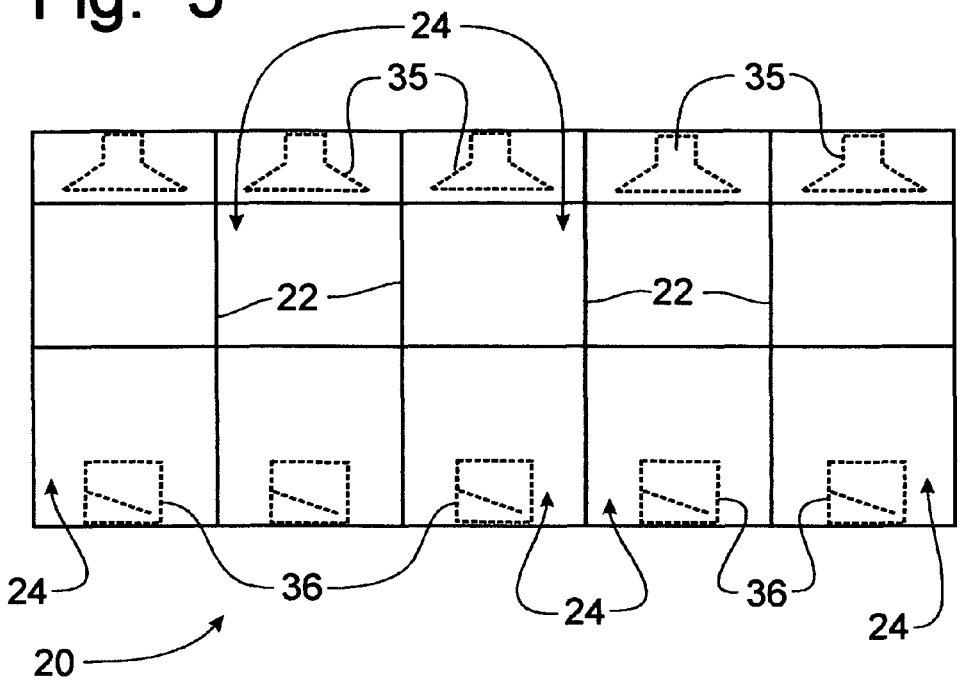
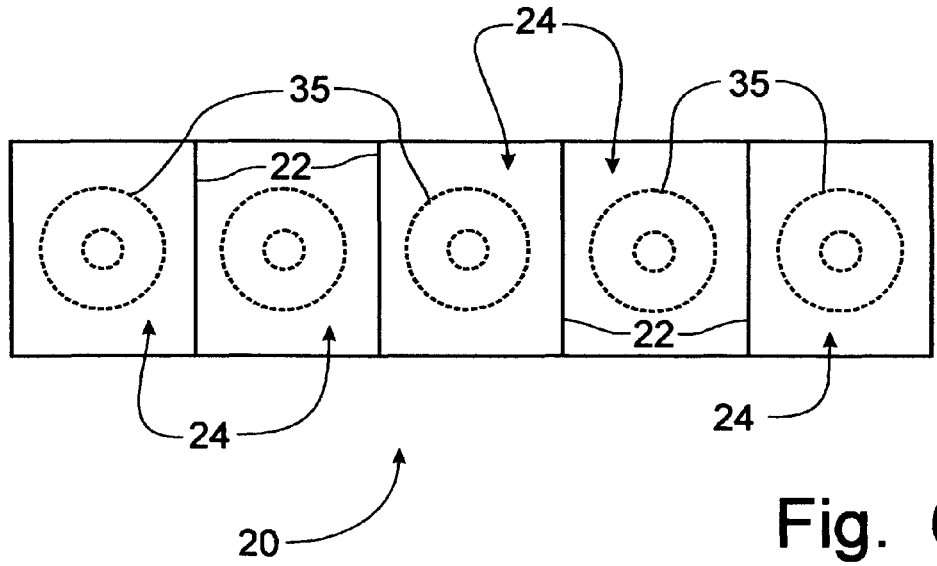
Fig. 6

Fig. 7
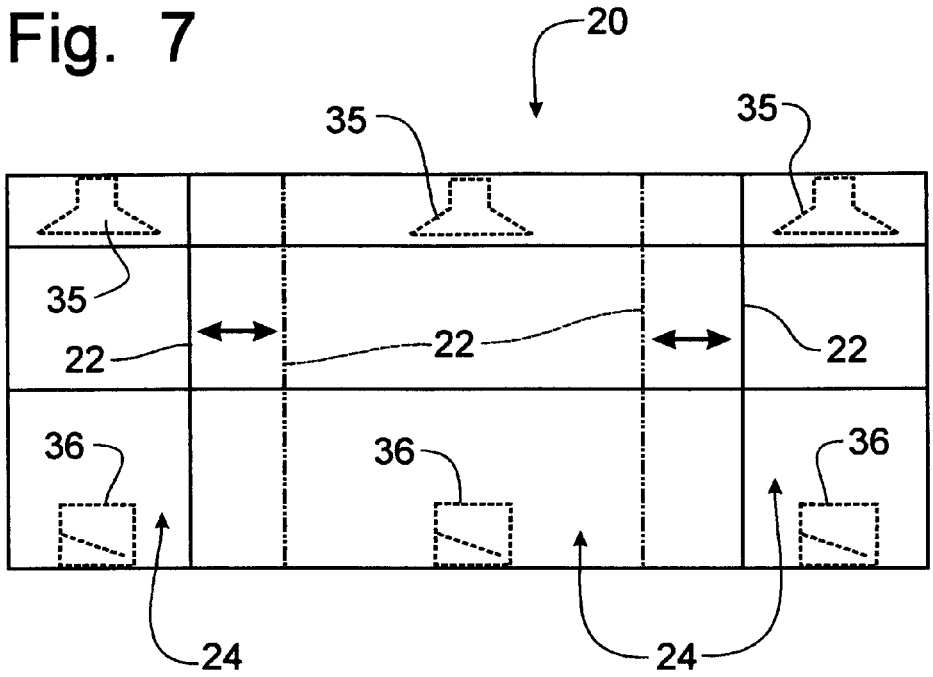
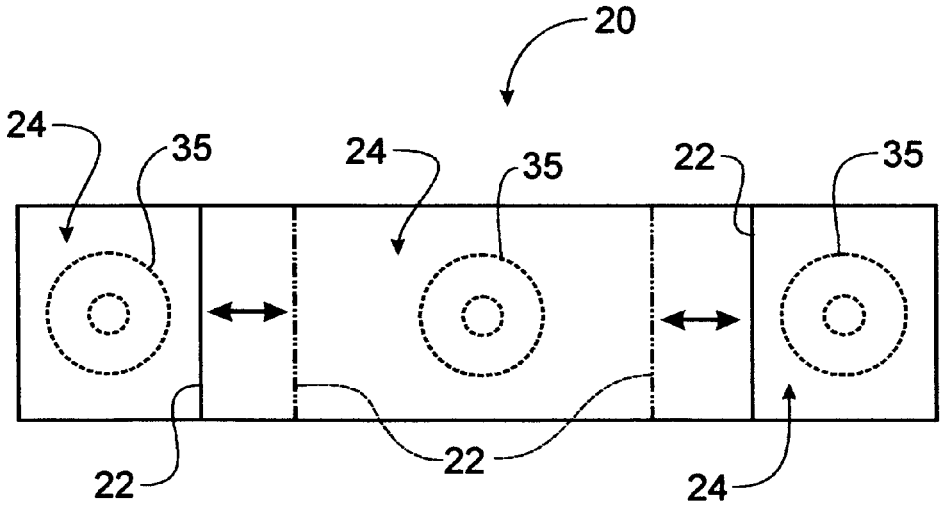
Fig. 8

MULTI-CHAMBER NOISE CONTROL SYSTEM

FIELD OF THE INVENTION

This invention relates generally to the control the noise generated by an automotive vehicle and, more particularly, to the reduction of noise in the passenger compartment of an automotive vehicle by controlling the transmission of the noise along the acoustic transfer path from the source of the noise to the receiver of the noise with a box-like structure divided into chambers to utilize the acoustic resonance of the respective chambers.

BACKGROUND OF THE INVENTION

The operation of the powertrain in an automobile is one of the major contributors of noise received within the passenger compartment of the automobile. With new powertrain technology, such as electronic valve actuation and variable displacement engine, new methods are needed to control the interior noise. In order to improve customer perceived interior noise quality, passenger compartment active noise control has been a popular strategy for study. Such methods of noise control are discussed below relative to prior art documents. Generally, these methods are expensive and only control the receiving end of the problem such as the passenger driver's ear positions, which can affect the speech intelligence to the passenger. Other methods of controlling noise are directed to the source, such as an active control of the induction or exhaust systems, have been developed. However, active control capability is limited and is very complex and expensive. Therefore, active noise control systems have not proven to be popular even though the methodology and technical capability have existed for many years.

An example of active passenger cabin sound suppression technology can be found in U.S. Pat. No. 4,506,380 granted to Shinichi Matsui on Mar. 19, 1985, in which speakers disposed in the dash panel of the vehicle are individually energized to selectively control the resonance occurred with respect to engine vibration. Similarly, an active vibration/noise control system in taught in U.S. Pat. No. 5,386,372, issued on Jan. 31, 1995, to Toshiski Kobayashi, et al, wherein speakers are arranged in suitable locations in the dashboard of the passenger compartment to control the noise from the engine. Self-expanding engine mounts have actuators formed of piezoelectric elements or magnetostrictive elements to prevent the vibrations from being transmitted from the engine.

Passive sound-absorbing materials are utilized throughout an automotive vehicle to reduce noise transmission. An example is found in U.S. Pat. No. 7,017,250, issued to Girma Gebreselassie, et al, on Mar. 28, 2006, wherein a dash insulator system has a substrate made from foam that is used to absorb the sound directed to a dash insulator. In U.S. Pat. No. 4,574,915, granted to Heinemann Gahlaii, et al on Mar. 11, 1986, sound-insulating cladding, formed from viscoelastic foam material is secured on the face of the front bulkhead to provide a sound-insulated area. Sound absorbing materials are used in the dashboard area of the vehicle to provide a passive noise control system preventing the noise generated in the engine compartment from being transmitted to the passenger compartment, as is suggested in U.S. Pat. No. 5,094,318, granted to Takashi Maeda, et al on Mar. 10, 1992; in U.S. Pat. No. 5,554,831, granted to Hiroshi Matsukawa, et al on Sep. 10, 1996; in U.S. Pat. No. 5,817,408, granted to Motohiro Orimo, et al on Oct. 6, 1998; in U.S. Pat. No. 6,102,465, granted to Kouichi Nemoto on Aug. 15, 2000; and in U.S. Pat. No. 6,554,101 granted to Kyoichi Watanabe on Apr. 29, 2003.

An isolator system, comprised of cast foam, is affixed to horizontal and vertical portions of the vehicle dash panel to reduce the transmission of unwanted noise and vibration from the engine compartment is taught in U.S. Pat. No. 6,767,050 granted to Christian Junker on Jul. 27, 2004, and assigned to Ford Global Technologies, LLC, and in U.S. Pat. No. 7,070,848 granted to Michael Campbell on Jul. 4, 2006. An automotive dash insulator system, used to reduce noise transmission from the engine to the interior of the vehicle, is formed with a sound-absorbing layer comprised of viscoelastic foam as depicted in U.S. Patent Application Publication No. 2005/0150720, of Jay Tudor, et al, published on Jul. 14, 2005.

A noise control system using a piezo-electric control scheme can be found in U.S. Pat. No. 6,589,643, granted on Jul. 8, 2003, to Jun Okada, et al, in which sound absorbing material, such as piezo-electric material, is used to insulate a dashboard in a vehicle to absorb and prevent the entry of low-frequency noise from the engine into the passenger compartment. In U. S. Patent Application Publication No. 2004/0130081 of David Hein, published on Jul. 8, 2004, a piezoelectric actuator and sensor assemblies are introduced between various structures contained within the instrument panel to minimize vibration within the instrument panel structure.

Adaptive filters have also been used to control noise generated from a noise source, such as the engine in an automobile, as taught in U.S. Pat. No. 5,131,047, issued to Hiroyuki Hashimoto, et al on Jul. 14, 1992, where a speaker is utilized to reproduce engine noise that controls the generated engine noise. In U.S. Pat. No. 5,321,759, granted to Yi Yuan on Jun. 14, 1994, adaptive filters having transversal filters are utilized in an active noise control system to control engine generated vibrational noise. A directional microphone is integrated into the dashboard to achieve a directional effect for controlling automotive noise is taught in U.S. Pat. No. 6,305,732, granted on Oct. 23, 2001, to Hans-Wilheim Ruhl. In U.S. Pat. No. 6,324,294, issued on Nov. 27, 2001 to Henry Azima, et al, loud speaker panels are attached to or installed in the dashboard of an automobile. U.S. Patent Application Publication No. 2004/0240678 of Yoshio Nakamura, et al, published Dec. 2, 2004, discloses an active noise control system that uses a speaker to control problematic noise generated by the engine.

It would be desirable to provide a system for reducing engine noise that is directed to the transfer path, rather than the source or the receiver of the noise. It would also be desirable to provide a system that utilizes a box-like structure imposed transversely across the transfer path so that the natural acoustic resonance of the structure can be utilized to aid in the control of the transmitted noise.

SUMMARY OF THE INVENTION

It is an object of this invention to overcome the aforementioned disadvantages of the known prior art by providing a noise control system that is directed to the transfer path of the noise transmission.

It is another object of this invention to provide an adaptive system for controlling noise generated at the engine that is deployed within the dual bulkhead plenum of an automotive dashboard.

It is a feature of this invention that the dual bulkhead plenum in the vehicle dashboard is located along the transfer path along which engine noise is transmitted into the passenger compartment.

It is an advantage of this invention that utilization of sound control techniques within the dual bulkhead plenum is directed to the transmission of the noise, as opposed to being directed to the source or receiver of the noise.

It is another feature of this invention that the constrained volume of the dual bulkhead plenum helps to provide a more efficient noise control system.

It is still another advantage of this invention that the deployment of simple hardware or software systems can provide a low cost and high capability active noise control within the dual bulkhead plenum of the vehicle dashboard to affect noise within the passenger compartment.

It is still another object of this invention to reduce the transmission of engine noise into the passenger compartment of an automotive vehicle by interrupting the transfer path of the noise transmission.

It is still another feature of this invention to provide an adaptive noise control system within the dual bulkhead plenum of an automotive dashboard.

It is yet another feature of this invention to utilize speakers within the dual bulkhead plenum to control engine noise being transmitted through the plenum.

It is yet another advantage of this invention that the plenum can be damped with sound absorbing acoustic materials attached to the surface of the sheet metal forming the bulkhead.

It is a further advantage of this invention that the noise control system is placed in a less harsh environment than being utilized at the source of the noise.

It is still a further advantage of this invention that the noise control system can be adapted to any automotive vehicle utilizing a dual bulkhead instrument panel design.

It is yet another object of this invention to divide the box-like structure imposed across the transfer path of the noise being transmitted into chambers within each of which is located an apparatus for creating a counteracting noise generation device.

It is a further feature of this invention that the individual chambers has a natural acoustic resonance that can be utilized to amplify the counteracting noise that is generated therein to control the transmission of the noise along the transfer path.

It is still another advantage of this invention that the natural acoustic resonance of the individual chambers formed in the dual bulkhead plenum will enhance the operation of the noise control system.

It is still a further feature of this invention that the internal walls within the dual bulkhead plenum can be positioned to provide variable geometry chambers.

It is yet another advantage of this invention that the different geometries of the internal chambers provide correspondingly different acoustic resonances that can be tuned to provide an optimized packaging and noise control strategy.

It is yet a further feature of this invention that the respective chambers formed within the dual bulkhead plenum can be tuned for different acoustic modes.

It is a further advantage of this invention the noise permitted to transfer to the driver's side of the passenger compartment can be different than the noise permitted to transfer to the passenger side of the passenger compartment.

It is yet another object of this invention to provide a noise control system, utilizing a multi-chamber plenum design placed along the transmission transfer path of the noise, which is durable in construction, inexpensive of manufacture, carefree of maintenance, facile in assemblage, and simple and effective in use.

These and other objects, features and advantages are accomplished according to the instant invention by providing a noise control system operable within a box-like structure provided by the dual bulkhead plenum of the vehicle dashboard positioned within the transfer path along which the noise is being transmitted from the source of the generated noise to the receiver of the noise in the passenger compartment of an automobile. The plenum is divided into discrete chambers into each of which is provided a counter noise generating apparatus to create a counteracting noise offsetting the noise generated at the source. The acoustic resonance of the chambers amplifies the noise control energy. The geometry of the individual chambers can be varied to optimize the packaging and sound control or shaping strategy. The sound energy permitted to pass through the plenum to the driver's side of the passenger compartment can be tuned to be different than the noise received in the passenger's side.

BRIEF DESCRIPTION OF THE DRAWINGS

The advantages of this invention will become apparent upon consideration of the following detailed disclosure of the invention, especially when taken in conjunction with the accompanying drawings wherein:

FIG. 1 is a partial schematic side elevational view of an automotive vehicle having a noise control system incorporating the principles of the instant invention;

FIG. 2 is a partial schematic perspective view of an automotive vehicle having a dual bulkhead plenum into which the noise control system is deployed to control the transmission of engine noise into the passenger compartment;

FIG. 3 is a diagrammatic view of the active noise control system utilizing speakers mounted in the dual bulkhead plenum of the automotive instrumentation panel;

FIG. 4 is a schematic side elevational view of the dual bulkhead plenum to depict the application of acoustic material within the plenum;

FIG. 5 is a schematic front elevational view of the plenum divided into discrete chambers into each of which is placed a counter noise generating apparatus;

FIG. 6 is a schematic top plan view of the plenum depicted in FIG. 5;

FIG. 7 is a schematic front elevational view of the plenum divided into chambers having a variably positionable internal wall to define internal chambers with tunable geometry, the movement of the internal walls being shown in phantom; and FIG. 8 is a schematic top plan view of the plenum depicted in FIG. 7.

DETAILED DESCRIPTION OF THE PREFERRED EMBODIMENT

Referring to FIGS. 1-4, an automotive vehicle incorporating the principles of the instant invention can best be seen. The control of undesirable noise intruding into the passenger compartment of an automobile has been the subject of recent development. Some noise control systems take the approach of countering the sound waves after they enter the passenger compartment, such as by introducing opposing sound waves via speakers appropriately arranged within the passenger compartment. Other noise control systems take the approach of countering the sound waves at the point of generation, such as by introducing opposing sound waves by speakers located appropriately within and/or around the engine, such as a speaker positioned at the air intake for the engine. The instant invention takes a unique approach to the control of noise by countering the sound waves along the transfer path of the noise, as opposed to at the receiver or at the generator.

To control acoustic transfer functions between the source, e.g. the engine 13, and the receiver, e.g. the passenger cabin 12 of the automobile 10, a box-like structure, which is defined with respect to the instant application as being a structure having a fixed volume, is placed along the transfer path between the generator and receiver. In some automotive vehicles 10, the instrument panel 15 is provided with a dual bulkhead plenum 20 located between the engine 13 and the passenger compartment 12. The dual bulkhead plenum 20 provides a suitable box-like structure for controlling the transfer of sound waves or vibrations along the transfer path through the instrument panel 15 in to the passenger compartment 12. Due to the lower level of sound or vibrational energy passing through the plenum 20 and the constrained volume of the plenum 20, very low cost, yet high capability, active noise control system can be utilized within the plenum 20 utilizing relatively simple hardware and software systems.

The noise control system 30 can include sensors 31 within the engine compartment to identify the frequency and amplitude of the sound energy being produced by the engine 13 for transfer to the passenger compartment 12 through the dual bulkhead plenum 20, and sensors 32 within the passenger compartment 12 to identify the frequency and amplitude of the sound energy being transmitted into the passenger compartment 12. These sensors 31 ascertain the acoustic environment of the vehicle 10 and can sense conditions such as temperature, vehicle speed, and engine RPM's. Thus, these sensors 31 can be utilized in an open loop control system employing a control algorithm that can result in the production of a counteracting sound wave introduced by speakers 35 within the plenum 20. The controller 25 employs a mathematical model of the vehicle's acoustic response to these environmental conditions through the control algorithm and generates the counteracting sound wave in response to the predicted sound energy level.

Accordingly, speakers 35 are placed within the plenum 20 to introduce the countering sound energy to control the sound waves being transmitted along the transfer path through the plenum 20. Vibrational energy can also be countered by opposing counteractive vibrational energy, which can be induced into the plenum 20 by a vibrator 36, schematically depicted in FIG. 4, that generates a vibration in the walls of the plenum that has an opposite amplitude and frequency to the vibrations emanating from the engine 13 or other vehicle component and being transmitted through the plenum 20. As an alternative to providing opposing amplitude and frequency to the sound and/or vibrations passing through the plenum 20, the speakers 35 and/or vibrators 36 can shape the sound being transmitted through the plenum 20 by providing partially opposing amplitude and frequency, thus allowing predetermined sounds or vibrations to reach the passenger compartment.

Instead of the traditional feed forward/feedback active noise control, adaptive transversal filters can be applied in the noise control system 30. Adaptive control is a special type of open loop active control in which the controller 25 employs a mathematical model of the vehicle's acoustic response, and possibly of the actuators and sensors. Due to the possible change of the acoustic environment over time, because of changes in temperature and other operating conditions for the vehicle 10, the adaptive controller 25 monitors the response, such as through the sensors 32 to identify the success of the noise control system 30 in controlling the generated noise, and continually or periodically updates the internal model of the system.

Alternatively, or as an optional addition to the speakers 35 and or vibrators 36, the plenum 20 can be lined with acoustic materials 27, 29, as are depicted in FIG. 4. Examples of this passive approach to sound management are acoustic damping materials, such as a damping sheet with a viscoelastic surface to provide a high damping over broad temperatures and frequency ranges. Acoustic absorption materials, such as acoustic foam 29, can provide maximum sound absorption with minimal thickness layers of foam applies to the surface of the sheet metal of the plenum 20 to reduce reverberation. Acoustic barrier materials, such as a heavy vinyl barrier 27 to block airborne sound with foam to reduce impact noise, provide maximum sound attenuation with high transmission loss. Coupling the passive acoustic materials with the active sound control system 30 can provide a highly capable noise control system, as is reflected in FIG. 4.

Referring now to FIGS. 5-8, the plenum 20 can be divided by internal walls 22 into a plurality of discrete chambers 24. Each chamber 24 has mounted therein a noise control system 30, such as a speaker 35 and a vibration generator 36. Each chamber 24 will have a natural acoustic resonance. This acoustic resonance can be utilized to amplify the counteracting noise generated by the noise control system 30. As a result, a low cost and high capability active noise control can be accomplished with simple hardware or software systems. While five chambers 24 are represented in the drawings, the number of chambers 24 provided in the plenum 20 will depend on the geometry of the plenum 20, the specifics of the noise control system 30 that is employed, and the results that are desired, as will be described in greater detail below. The controller 25 can be operable to control each of the speakers 35 and/or shakers 36 within the chambers 24 separately such that each chamber 24 produces a different noise control energy corresponding to the noise energy passing through the chamber 24, as the respective chambers 24 can be subjected to different generated noise energy.

As depicted in FIGS. 7-8, the internal walls 22 can be variably positionable within the plenum 20 by providing multiple sets of hangers (not shown) on which the internal walls 22 can be mounted. As a result, the chambers 24 can have variable geometry and a resultant variable acoustic resonance. Thus, the individual chambers 24 can be sized and tuned to provide different desired results to different parts of the passenger compartment 12. For example, if certain engine generated sounds and/or certain road noise is deemed desirable for the driver of the vehicle 10, which noise would not be desirable for the passenger on the opposing side of the vehicle 10, the corresponding chambers 24 can be configured to provide a desired acoustic mode for the amplification of the noise control energy in a manner to allow certain noise frequencies to pass through the plenum 20 to the driver's side of the passenger compartment 12, while eliminating those frequencies into the passenger side of the passenger compartment 12. Furthermore, the chambers 24 can be configured to optimize the packaging of the speaker 35 and/or shaker 36 output power with respect to the sound control or sound shaping strategy to be employed by the noise control system 30.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

For example, this noise control technology can be adapted and expanded for use in other vehicle structures, such as the wheel fender and trunk, wherever a fixed volume can be realized within the confines of the vehicle structure. Other applications of this noise control technology would include construction equipment, and other heavy equipment, the aerospace industry, and the heating, ventilation and air conditioning industry.

Having thus described the invention, what is claimed is:

1. An automotive vehicle, comprising:

a chassis defining an engine compartment and a longitudinally spaced passenger compartment;

an engine mounted in said engine compartment and being operable to generate noise energy along a transfer path into said passenger compartment;

a transverse closed box-like structure interposed between said engine compartment and said passenger compartment and having a transverse width sufficient to intercept the noise energy being transmitted from said engine to said passenger compartment along said transfer path, said box-like structure being divided into a plurality of discrete chambers by internal longitudinally extending walls; and a noise control system placed within each said chamber of said box-like structure to control the transfer of said noise energy into said passenger compartment, said noise control system including a counteracting noise generating apparatus disposed within each said chamber and being operable to produce counteracting noise energy for the generated noise energy, each said noise control system corresponding to the respective chambers of said box-like structure being operable independently of each other respective noise control system to permit at least two of said chambers to produce different results with respect to the transmission of generated noise energy.

2. The automotive vehicle of claim 1 wherein said noise control system further includes a controller operably connected to said counteracting noise generating apparatus to operate the counteracting noise generating apparatus within each respective chamber independently of the other chambers.

3. The automotive vehicle of claim 2 wherein the counteracting noise generating apparatus in one chamber is operated to allow certain generated noise energy to pass through to the passenger compartment, while another chamber is operated to control said certain generated noise energy.

4. The automotive vehicle of claim 2 wherein said internal walls can be positioned at different transversely spaced locations to provide respective chambers having different geometrical configurations, resulting in correspondingly different acoustic resonances.

5. The automotive vehicle of claim 4 wherein the acoustic resonance of each respective chamber is utilized as an amplifier for the counteracting noise energy generated by the counteracting noise generating apparatus.

6. The automotive vehicle of claim 5 wherein the transverse box-like structure is a dual bulkhead plenum connected to an instrument panel located at a forward position in said passenger compartment.

7. The automotive vehicle of claim 6 wherein said passenger compartment is divided into a driver side and a passenger side, the chambers corresponding to said driver side being operated to allow certain generated noise energy to pass through the chamber into said driver side, while the chambers corresponding to said passenger side are operated to control said certain generated noise energy.

8. The automotive vehicle of claim 7 wherein said noise control system further includes environmental sensors coupled to said controller to provide a signal indicative of operational environmental conditions relating to said generated noise energy, and response sensors positioned within said passenger compartment and coupled to said controller to provide a signal indicative of the generated noise energy reaching said passenger compartment.

9. A noise control system operable with a noise generating apparatus producing generated noise energy and a receiver located remotely from said noise generating apparatus to receive said generated noise energy, comprising:

a box-like structure located along a transfer path of said generated noise energy extending between said noise generating apparatus and said receiver, said box-like structure being located between said noise generating apparatus and said receiver and being divided into transversely spaced chambers by internal walls;

a counter energy generating apparatus positioned in each respective chamber to create counter noise energy to counteract said generated noise energy, each said counter energy generating apparatus being operable independently of each other respective counter energy generating apparatus to permit at least two of said chambers to produce different results with respect to the transmission of generated noise energy.

10. The noise control system of claim 9 further comprising a controller operably coupled to each of said counter energy generating apparatus to operate each respective said counter energy generating apparatus independently.

11. The noise control system of claim 10 further comprising:

environmental sensors positioned relative to said noise generating apparatus to detect operational environmental conditions pertinent to said noise generating apparatus, said environmental sensors being operably coupled to said controller to receive signals from said environmental sensors indicative of said operational environmental conditions; and response sensors positioned adjacent said receiver to detect generated noise energy received by said receiver, said response sensors being operably coupled to said controller to receive signals from said response sensors indicative of said generated noise energy received by said receiver.

12. The noise control system of claim 11 wherein said internal walls can be positioned at different transversely spaced locations to provide respective chambers having different geometrical configurations, resulting in correspondingly different acoustic resonances.

13. The noise control system of claim 12 wherein the acoustic resonance of each respective chamber is utilized as an amplifier for the counteracting noise energy generated by the counteracting noise generating apparatus.

14. The noise control system of claim 13 wherein the box-like structure is a dual bulkhead plenum connected to an instrument panel on an automotive vehicle located at a forward position in a passenger compartment of said vehicle.

15. The noise control system of claim 14 wherein said passenger compartment is divided into a driver side and a passenger side, the chambers corresponding to said driver side being operated to allow certain generated noise energy to pass through the chamber into said driver side, while the chambers corresponding to said passenger side are operated to control said certain generated noise energy.

16. A method of controlling a transmission of noise energy in an automobile having a noise generating apparatus producing generated noise energy and a passenger compartment receiving said generated noise energy, comprising the steps of:

intercepting said generated noise energy along a transfer path of said generated noise energy extending between said noise generating apparatus and said passenger compartment by a transversely extending closed box-like structure;

dividing said box-like structure into transversely positioned chambers by internal walls mounted within said box-like structure;

mounting a counter energy generating device within each said chamber;

creating counter noise energy by said counter energy generating devices independently within said chambers to counteract said generated noise energy transmitted through each respective said chamber, at least two of said chambers having different results with respect to the transmission of generated noise energy.

17. The method of claim 16 wherein said dividing step creates chambers having different geometric configurations, said creating step being tuned to an acoustic resonance of the respective said chamber.

18. The method of claim 16 wherein said at least two of said chambers correspond to a driver side and a passenger side, respectively of said passenger compartment.

19. The method of claim 16 wherein said box-like structure is a dual bulkhead plenum of an instrument panel for said automobile, said counter energy generating devices including a speaker operable to generate counteracting sound waves to counteract generated sound waves in said generated noise energy, said mounting step including the step of mounting one of said speakers in each respective said chamber.

20. The method of claim 19 further comprises the steps of:

sensing operational environmental conditions of said automobile by sensors operable to generate a signal indicative of said operation environmental conditions; and operably coupling said sensors to a controller which is operable to control each said speaker independently in the generation of counteracting sound waves to counteract said generated sound waves passing through each respective said chamber.

* * * * *